US007088934B2

(12) United States Patent
Lee

(10) Patent No.: US 7,088,934 B2
(45) Date of Patent: Aug. 8, 2006

(54) FUSING SYSTEM AND TEMPERATURE CONTROL METHOD THEREOF FOR USE IN AN IMAGE FORMING APPARATUS

(75) Inventor: Beom-ro Lee, Suwon (KR)

(73) Assignee: Samsung Electronics Co., Ltd. (KR)

( * ) Notice: Subject to any disclaimer, the term of this patent is extended or adjusted under 35 U.S.C. 154(b) by 138 days.

(21) Appl. No.: 10/765,068

(22) Filed: Jan. 28, 2004

(65) Prior Publication Data

US 2005/0008384 A1 Jan. 13, 2005

(30) Foreign Application Priority Data

Jul. 10, 2003 (KR) ..... 10-2003-0046990

(51) Int. Cl.
*G03G 15/20* (2006.01)

(52) U.S. Cl. ..... 399/67

(58) Field of Classification Search ..... 399/67, 399/69; 219/216

See application file for complete search history.

(56) References Cited

U.S. PATENT DOCUMENTS 5,479,240 A * 12/1995 Lee et al.
5,504,567 A * 4/1996 Satoh et al. ..... 219/216
5,640,646 A * 6/1997 Toyohara et al. ..... 399/69
6,108,019 A * 8/2000 Katsuma et al.
6,118,967 A * 9/2000 Kagawa et al. ..... 399/69
6,285,663 B1 9/2001 Esmailzadeh ..... 370/311
6,634,817 B1 * 10/2003 Serizawa
6,701,102 B1 * 3/2004 Hasegawa et al. ..... 399/69
6,885,834 B1 * 4/2005 Ito et al. ..... 399/67
2003/0218769 A1 * 11/2003 Otsuka

FOREIGN PATENT DOCUMENTS

JP 60050566 A * 3/1985
JP 05212901 A * 8/1993
JP 10-288935 10/1998
JP 11202672 A * 7/1999

* cited by examiner

*Primary Examiner*—Susan Lee
(74) *Attorney, Agent, or Firm*—Roylance, Abrams, Berdo, & Goodman, LLP

(57) ABSTRACT

A fusing system and a temperature control method thereof for use in an image forming apparatus. The fusing system includes a control unit having a controller. The controller determines whether to initiate a heater driving-start timing, on the basis of one of a first time t1 and a third time t3, and a second time t2, when a sheet of printing paper is picked up by the pickup roller, or when a leading end of the sheet of the printing paper picked up by the pickup roller operates the paper jam sensor, the first time t1 being a time when the sheet of printing paper is picked up to a point of time when the sheet of printing paper arrives at the fusing roller, the second time t2 being a time required until a heat generated from the heater arrives at a surface of the fusing roller, and the third time t3 being a time from when the sheet of printing paper operates the paper jam sensor to when the sheet of printing paper is arrives at the fusing roller.

18 Claims, 7 Drawing Sheets

FUSING SYSTEM AND TEMPERATURE CONTROL METHOD THEREOF FOR USE IN AN IMAGE FORMING APPARATUS

CROSS-REFERENCE TO RELATED APPLICATIONS

This application claims the priority of Korean Patent Application No. 2003-46990, filed on Jul. 10, 2003, in the Korean Intellectual Property Office, the disclosure of which is incorporated herein in its entirety by reference.

BACKGROUND OF THE INVENTION

1. Field of the Invention

The present invention relates to a fusing system and a temperature control method thereof for use in an image forming apparatus such as a laser beam printer, a facsimile machine (FAX), a copier, and the like, and more particularly, it relates to a fusing system and a temperature control method thereof for use in an image forming apparatus, which is capable of stably fusing a toner image onto a recording medium such as a sheet of printing paper, by minimizing a fluctuation width in surface temperature of a fusing roller in the fusing system.

2. Description of the Prior Art

A general image forming apparatus such as a copier, a laser beam printer and the like, prints a desired image on a recording medium i.e. a sheet of printing paper using a series of image forming processes. The image forming processes include electrically charging a surface of a photosensitive drum by rotating an electrostatic charging roller disposed adjacent to the photosensitive drum, exposing the surface of the photosensitive drum to a laser beam projecting from a laser scanning unit (LSU) to thus form an electrostatic latent image on the surface of the photosensitive drum, developing the electrostatic latent image formed on the surface of the photosensitive drum into a toner image having a powdery state i.e. a visible image by applying a toner to the surface of the photosensitive drum, transferring the toner image formed on the surface of the photosensitive drum onto the sheet of printing paper which passes between the photosensitive drum and a transfer roller which are in contact with each other under a predetermined pressure, supplying a predetermined transfer voltage to the transfer roller and the photosensitive drum, and fusing the toner image of the powdery state to affix it onto the sheet of printing paper by heating the sheet of printing paper with the toner image transferred thereon through a fusing system including a fusing roller.

Generally, in the process of fusing the toner image, a halogen lamp is employed as a heating source for the fusing system. The halogen lamp is disposed inside the fusing roller and/or a fusing backup roller to heat a surface of the fusing roller and/or the fusing backup roller to a predetermined temperature using a radiant heat thereof.

FIG. 1 is a block diagram illustrating an example of a fusing system 10 of a general electrophotographic image forming apparatus.

The fusing system 10 includes a cylinder-shaped fusing roller 11, and a halogen lamp 12 disposed in an inner center thereof. The halogen lamp 12 generates heat inside the fusing roller 11,.

Disposed under the fusing roller 11 is a fusing backup roller 13. As shown in FIG. 3, the fusing backup roller 13 is resiliently supported by a spring 13*a*, to enable the pressing of a sheet of printing paper 14 passing between the fusing roller 11 and the fusing-backup roller 13, toward the fusing roller 11 with a predetermined pressure.

Accordingly, while the sheet of printing paper 14 is passing between the fusing roller 11 and the fusing backup roller 13, a toner image 14*a* formed on the sheet of printing paper 14 in the powdery state is subjected to a predetermined pressure and a predetermined heat. As a result, the toner image 14*a* is fused and fixed onto the sheet of printing paper 14 by the predetermined pressure and the predetermined heat imposed thereto via the fusing roller 11 and the fusing-backup roller 13.

Referring to FIG. 1, installed at a side of the fusing roller 11 are a thermistor 15, a thermostat 16 and a power switching part 19 such as a thyristor. The thermistor 15 is for detecting or sensing a surface temperature of the fusing roller 11 via an electric signal, the thermostat 16 is for blocking an electric power to the halogen lamp 12 when the surface temperature of the fusing roller 11 exceeds a given threshold, and the power switching part 19 is for switching a power supply of an AC power source 18 to the halogen lamp 12 according to a signal from a controller 20.

The thermistor 15 detects the surface temperature of the fusing roller 11, and transmits the detected temperature to the controller 20. The controller 20 compares the detected temperature with a predetermined set temperature, and regulates the power supply to the halogen lamp 12 using the power switching part 19, thereby maintaining the surface temperature of the fusing roller 11 at a fusing temperature suitable to fuse the toner image 14*a* and to affix it onto the sheet of printing paper 14.

As shown in FIG. 4, the controller 20 usually controls the surface temperature of the fusing roller 11 using a temperature control process that includes an initial heating step S1 of heating the surface temperature of the fusing roller 11 to a print standby temperature, a print standby step S2 of maintaining the surface temperature of the fusing roller 11 at the print standby temperature and waiting for a print command, and a printing step S3, S4, S5 and S6 of maintaining the surface temperature of the fusing roller 11 higher than the print standby temperature to offset a loss in heat which occurs during the fusing operation of fusing the toner image.

At each of the steps S1 through S6 of the temperature control process, the controller 20 controls the power supply to the halogen lamp 12, by comparing the detected surface temperature of the fusing roller 11 with the set temperature and then turning on the halogen lamp 12 through the power switching part 19 when the detected temperature is below the set temperature and turning off the halogen lamp 12 when the detected temperature is above the set temperature, and thereby the surface temperature of the fusing roller 11 is maintained within a given range.

Also, the thermostat 16 functions as an overheating prevention means to protect the fusing roller 11 and its neighboring components, in case the thermistor 15 and the controller 20 fail to regulate the surface temperature of the fusing roller 11.

In such a conventional fusing system 10, as shown in FIG. 2, the fusing roller 11 is usually comprised of an aluminum cylinder having a rubber layer 11*a* of low thermal conductivity coated on an outer surface thereof.

The rubber layer 11*a* functions to make the sheet of printing paper 14 maintain a given contact area with the fusing roller 11 while it passes through a nip between the fusing roller 11 and the fusing backup roller 13, thereby providing enough time to supply the heat radiated from the halogen lamp 12 to the sheet of printing paper 14, and at the same time, keep the heat radiated from the halogen lamp 12, thereby preventing the surface temperature of the fusing roller 11 from suddenly lowering even though the sheet of printing paper 14 passes therethrough. However, due to low thermal conductivity, the rubber layer 11*a* presents a problem of increasing the time required for the heat supplied from the halogen lamp 12 to reach the surface of the fusing roller 11.

More specifically, in the process of fusing the toner image, when the halogen lamp 12 is turned off after the thermistor 15 detects that a surface temperature of the rubber layer 11*a* of the fusing roller 11 has reached the fusing temperature, the surface temperature of the rubber layer 11*a* continues to increase above the fusing temperature for a given period due to the heat of the aluminum cylinder of the fusing roller 11 heated by the halogen lamp 12 to reach fusing temperature.

Also, when the halogen lamp 12 is turned on after the thermistor 15 detects that the surface temperature of the rubber layer 11*a* of the fusing roller 11 has fallen below the fusing temperature, the surface temperature of the rubber layer 11*a* further drops for a given time until the temperature of the aluminum cylinder rises to a certain temperature level able to increase the surface temperature of the rubber layer 11*a* to the fusing temperature. Since the temperature of the aluminum cylinder goes below the certain temperature that is able to increase the surface temperature of the rubber layer 11*a* to the fusing temperature, for a given time the surface temperature of the rubber layer 11*a* rises above the fusing temperature due to the heat of the aluminum cylinder of the fusing roller 11.

For example, as shown in FIG. 5, when the halogen lamp 12 is driven for 90 seconds and then turned off after the surface temperature of the rubber layer 11*a* of the fusing roller 11 has reached the fusing temperature, for example, 180° C., the surface temperature of the rubber layer 11*a* further rises above the fusing temperature, since the aluminum cylinder of the fusing roller 11 has been heated to a temperature of 230° C. Whereas, when the halogen lamp 12 is turned on after the surface temperature of the rubber layer 11*a* of the fusing roller 11 has risen above the fusing temperature due to the temperature of the aluminum cylinder of the fusing roller 11 and then fallen again below the fusing temperature, the surface temperature of the rubber layer 11*a* further falls for a given time until the heat of the aluminum cylinder of the fusing roller 11 heated by the halogen lamp 12 reaches the surface of the rubber layer 11*a*.

Thus, the fusing roller 11 having the rubber layer 11*a* does not suddenly change the surface temperature thereof as compared with a fusing roller formed of only an aluminum cylinder but, instead, presents a problem of increasing the fluctuation width in the surface temperature thereof.

If the fluctuation width in the surface temperature of the fusing roller 11 increases, the fusing temperature is unstably regulated. Thereby, when the sheet of printing paper passes through the fusing roller, the toner image formed on the sheet of printing paper is irregularly fused and affixed.

Accordingly, in order to solve the problem of the fusing roller 11 having the rubber layer 11*a*, a new fusing system and a temperature control method, which does not simply turn on or off the halogen lamp 12 at predetermined or non-predetermined intervals of time by using the thermistor 15, as in the conventional fusing system 10. The new fusing system and temperature control method should regulate the surface temperature of the fusing roller 11 into the fusing temperature, by taking into account the fluctuation difference in the surface temperature of the rubber layer 11*a*.

SUMMARY OF THE INVENTION

The present invention has been developed in order to solve the above problem in the prior art. Accordingly, it is an aspect of the present invention to provide a fusing system and a temperature control method thereof for use in an image forming apparatus which, in order to coincide a point of time when a sheet of printing paper arrives at a fusing roller with a point of time when a heat of a heater previously heated reaches a surface of the fusing roller through a rubber layer and the like, determines a heater driving-start timing and a heater driving time for a paper supply, taking into account a time required until the sheet of printing paper arrives at the fusing roller and a time required until the heat radiated from the heater reaches to the surface of the fusing roller, and then drives the heater for the determined heater driving time, thereby minimizing a fluctuation width in surface temperature of the fusing roller to stably maintain the surface temperature of the fusing roller and at the same time, to stably affix a toner image on the sheet of printing paper.

According to an embodiment of the present invention to achieve the above aspect and other advantages, a fusing system of an image forming apparatus comprises a fusing unit having a fusing roller and a heater for heating the fusing roller; and a fusing temperature control unit comprising a paper feeding part having at least one of a pickup roller for picking up a sheet of printing paper and a paper jam sensor, a sensor part for sensing a surface temperature Temp of the fusing roller, and a controller for determining whether it is a heater driving-start timing to drive the heater for heating the fusing roller of the fusing unit when a sheet of printing paper is fed by the paper feeding part, and driving the heater when it is determined that it is the heater driving-start timing.

In this case, the controller determines whether it is a heater driving-start timing, on the basis of one of a first time t1 and a third time t3, and a second time t2, when a sheet of printing paper is picked up by the pickup roller, or when a leading end of the sheet of printing paper picked up by the pickup roller operates the paper jam sensor. The first time t1 being a time from when the sheet of printing paper is picked up to a point of time when the sheet of printing paper arrives at the fusing roller. The second time t2 being a time required until a heat generated from the heater reaches to a surface of the fusing roller. The third time t3 being a time from when the sheet of printing paper operates the paper jam sensor to when the sheet of printing paper arrives at the fusing roller. When it is determined that it is the heater driving-start timing, the controller calculates a heater driving time th according to at least one factor selected from the group consisting of a target surface temperature Tt for the fusing roller previously determined at a temperature required in fusing, a surface temperature Temp of the fusing roller detected by the sensor part, and a changeable slope a of the surface temperature Temp of the fusing roller and then drives the heater for the calculated heater driving time th.

The heater driving-start timing may be determined by subtraction of the second time t2 from the one of the first time t1 and the third time t3.

At this point, it is preferable that the heater driving time th is calculated using the following mathematical formula.

$$th=\alpha\times(Tt-\text{Temp})-\beta\times a+\gamma,$$

where $\alpha$ is a proportional constant, $\beta$ is a differential coefficient, and $\gamma$ is a constant.

Alternatively, to prevent the leading end of the sheet of printing paper fed to the fusing roller from being heated above the target surface temperature Tt, the heater driving-start timing can be delayed for a predetermined time from the subtraction of the second time t2 from one of the first time t1 and the third time t3.

Also, it is preferable that the heater driving time th is determined not to exceed a period of paper supply, since it is again calculated when a following sheet of printing paper is supplied.

According to another embodiment of the present invention, a temperature control method of a fusing system for use in an image forming apparatus comprises steps of determining whether it is a heater driving-start time to drive a heater for heating a fusing roller of a fusing unit when a sheet of printing paper is fed by a paper feeding part, and driving a heater when it is determined that it is the heater driving-start time.

In this case, the step of determining whether it is the heater driving-start time may comprise determining whether the sheet of printing paper is fed by the paper feeding part, and determining whether it is the heater driving-start timing to drive the heater when it is determined the sheet of printing paper is fed by the paper feeding part.

The operation of determining whether the sheet of printing paper is fed by the paper feeding part may be performed by one of determining whether a pickup roller for picking up the sheet of printing paper of the paper feeding part is driven, and determining whether a paper jam sensor is operated, the paper jam sensor being disposed at a lower part in a paper feed direction of the pickup roller.

The operation of determining whether it is the heater driving-start timing may comprise determining one of a first time t1 and a third time t3, and a second time t2, the first time t1 being a time from when the sheet of printing paper is picked up by the pickup roller to when the sheet of printing paper arrives at the fusing roller, the second time t2 being a time required until a heat generated from the heater reaches to a surface of the fusing roller, and the third time t3 being a time from when the sheet of printing paper operates the paper jam sensor to when the sheet of printing paper arrives at the fusing roller, and determining the heater driving-start timing by determining whether a difference time t between one of the first time t1 and the third time t3 and the second time t2 elapses. To prevent a leading end of the sheet of printing paper fed to the fusing roller from being heated above a target surface temperature Tt for the fusing roller, the operation of determining the heater driving-start timing may be performed by delaying for a predetermined time after the difference time t between one of the first time t1 and the third time t3 and the second time t2 has elapsed. Here, it is preferable that the first time t1, the third time t3 and the second time t2 are previously measured and stored in the image forming apparatus, but it is possible that they are directly measured during the operation of the image forming apparatus, or obtained by comparing the previously stored value with the counted time and then correcting it in a value adapted to use in the image forming apparatus, thereby to correct deviation of the image forming apparatus.

The temperature control method of the present invention may further comprise the steps of determining whether the second time t2 is larger than the one of the first time t1 and the third time t3 after the operation of determining the one of the first time t1 and the third time t3, and the second time t2; and directly moving to the step of driving the heater when it is determined that the second time t2 is larger than one of the first time t1 and the third time t3.

At the step of driving the heater after the operation of determining the heater driving-start timing, the temperature control method of the present invention calculates a heater driving time th according to at least one factor selected from a target surface temperature Tt for the fusing roller previously determined at a temperature required in fusing, a surface temperature Temp of the fusing roller detected by a sensor part, and a changeable slope a of the surface temperature Temp of the fusing roller.

Also, the temperature control method of the present invention may further comprise the steps of determining whether the surface temperature Temp of the fusing roller is above the target surface temperature Tt after the operation of determining the heater driving-start timing by determining whether the difference time t elapses; and stopping the driving of the heater when it is determined that the surface temperature Temp of the fusing roller is above the target surface temperature Tt.

Also, when decided that the surface temperature Temp of the fusing roller is below the target surface temperature Tt at the steps of determining whether the surface temperature Temp of the fusing roller is above the target surface temperature Tt, the temperature control method of present invention may further comprise steps of determining whether a printing speed exceeds a predetermined speed, and controlling to alternately turn on and off the heater by the sensor part or in intervals of predetermined time when it is determined that the printing speed exceeds the predetermined speed. Particularly, when it is determined that the second time t2 is larger than one of the first time t1 and the third time t3 at the previous step, controlling to alternately turn on and off the heater to be more effective than calculating the heater driving time th and then driving the heater for the heater driving time th.

At this point, it is preferable that the printing speed is determined by one selected from an information of printing speed previously input in the image forming apparatus, a driving period of the pickup roller of the paper feeding part, and a feeding speed of the sheet of printing paper conveyed by a feed roller of the paper feeding part.

The step of driving the heater may comprise driving the heater for the calculated heater driving time th.

At this point, it is preferable that the heater driving-start time th is calculated by the following mathematical formula.

$$th=\alpha\times(Tt-\text{Temp})-\beta\times a+\gamma,$$

where $\alpha$ is a proportional constant,
$\beta$ is a differential coefficient, and
$\gamma$ is a constant.

BRIEF DESCRIPTION OF THE DRAWINGS

The above aspect and the other features of the present invention become apparent by describing embodiments of the present invention in greater detail with reference to the accompanying drawings, in which.

DETAILED DESCRIPTION OF THE PREFERRED EMBODIMENTS

Hereinafter, a fusing system and a temperature control method thereof for use in an image forming apparatus in accordance with the embodiments of the present invention will be described in greater detail with reference to the accompanying drawings.

Embodiment 1

Figure 6:
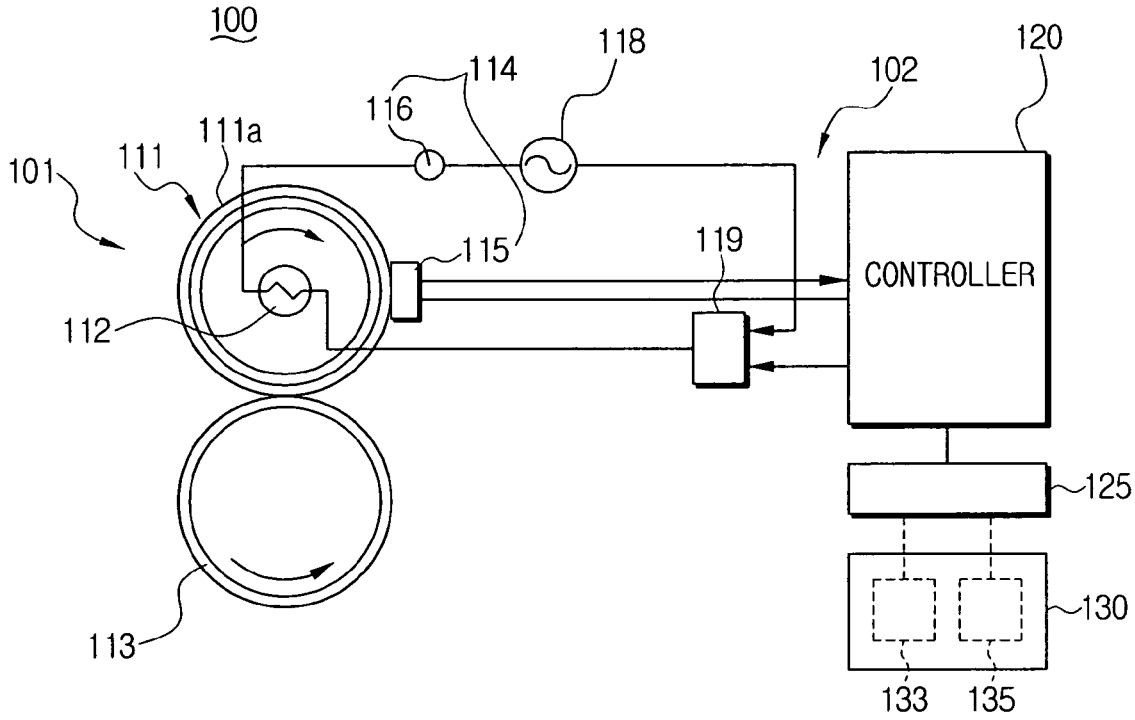
FIG. 6 is a perspective view of a fusing system of an electrophotographic image forming apparatus according to a first embodiment of the present invention.

FIG. 6 is a block diagram illustrating a fusing system 100 according to a first embodiment of the present invention, which is applied to an electrophotographic image forming apparatus such as a laser printer, a copier, a FAX and the like.

The fusing system 100 includes a fusing unit 101 for fusing a toner image transferred onto a sheet of printing paper (not shown) with heat and pressure to affix it thereon and having a fusing roller 111 with a heater 112, and a fusing temperature control unit 102 determining a driving-start timing and a driving time th of the heater 112 of the fusing unit 101 for a paper supply and controlling the heater 112 to drive for the decided driving time th, to coincide a point of time when the sheet of printing paper arrives at the fusing roller 111 with a point of time when a heat of the preheated heater 112 reaches a surface of the fusing roller 111. The fusing unit 101 is provided with a fusing roller 111 formed of an aluminum cylinder having a rubber layer 111*a* coated on an outer surface thereof, a fusing-backup roller 113 disposed under the fusing roller 111 to press the fusing roller 111 with a predetermined pressure, and a heater 112 such as a halogen lamp disposed in an inner center of the fusing roller 111 to generate a fusing heat for fusing the toner image and affixing it onto the sheet of printing paper.

Figure 1:
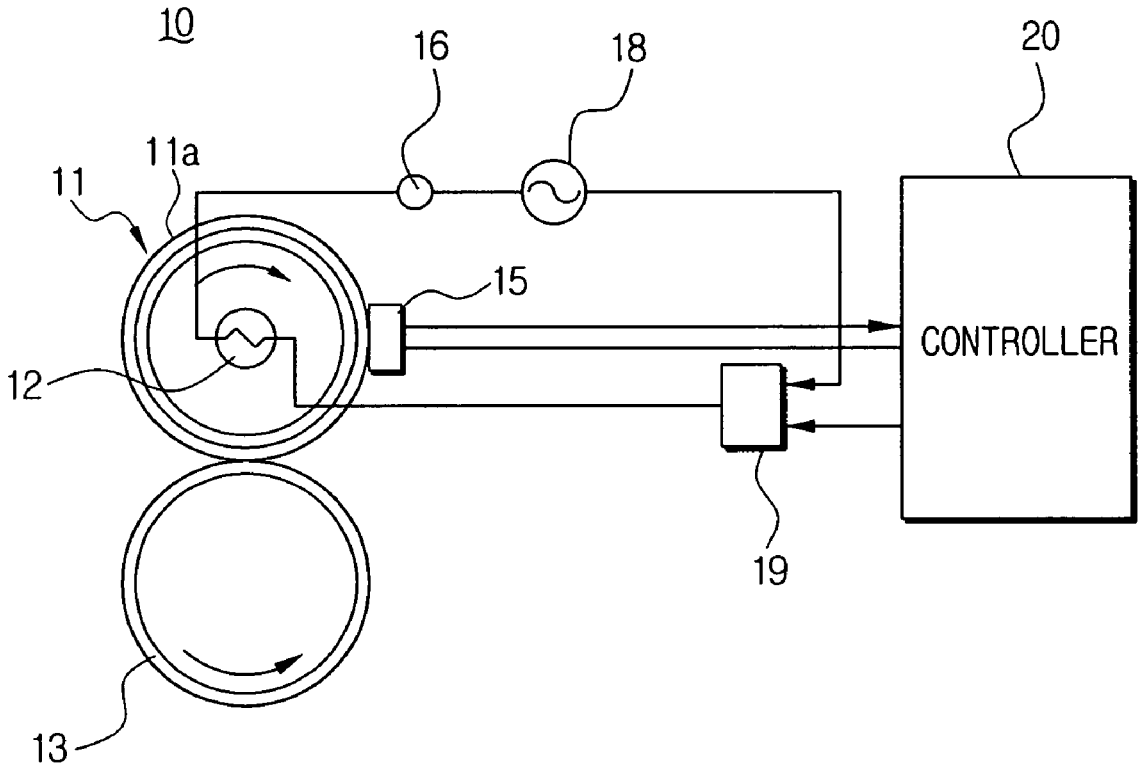
FIG. 1 (PRIOR ART)
FIG. 1 is a perspective view of a fusing system of a conventional electrophotographic image forming apparatus.
Figure 2:
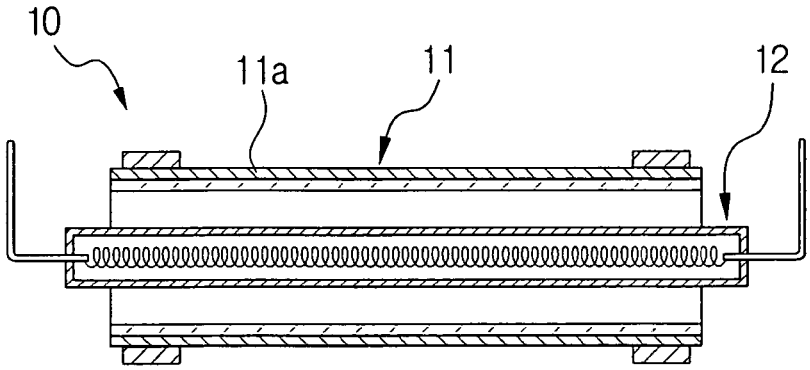
FIG. 2 (PRIOR ART)
FIG. 2 is a cross-sectional view of a fusing roller and a heater of the fusing system shown in FIG. 1.
Figure 3:
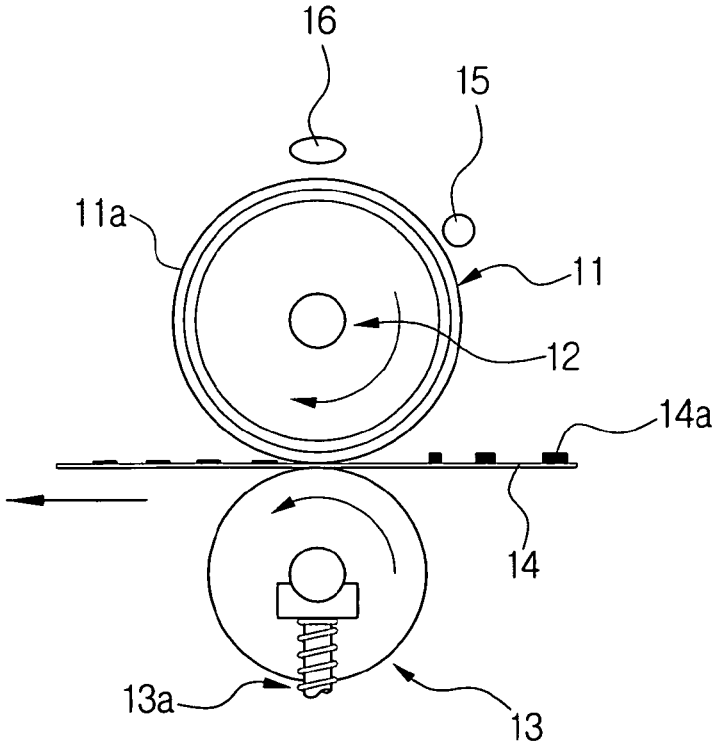
FIG. 3 (PRIOR ART)
FIG. 3 is a side elevation view illustrating a fusing operation of the fusing system shown in FIG. 1.
Figure 4:
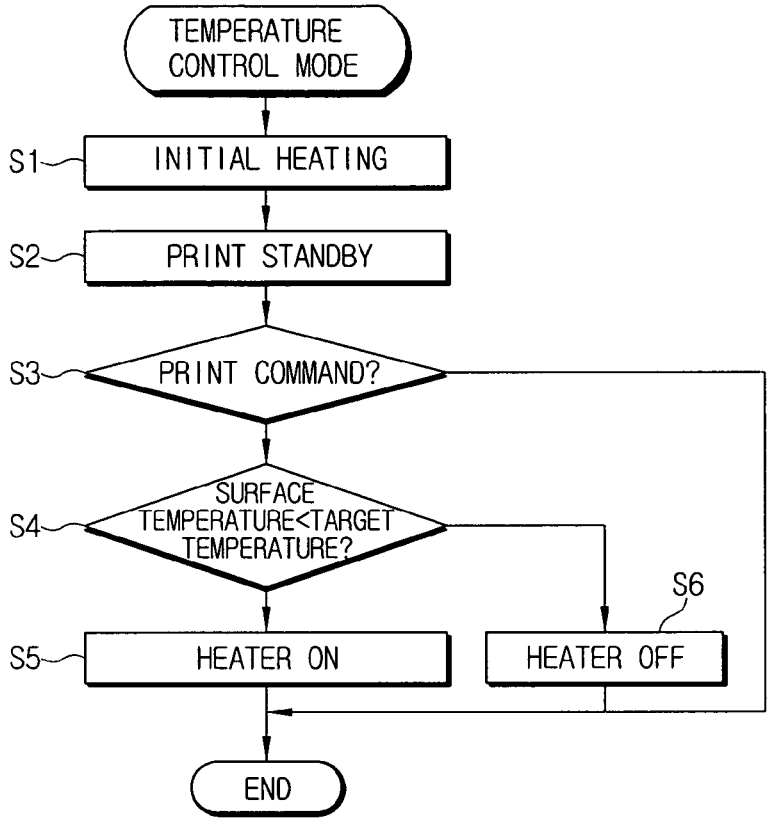
FIG. 4 (PRIOR ART)
FIG. 4 is a flow chart illustrating a temperature control process of the fusing system shown in FIG. 1.
Figure 5:
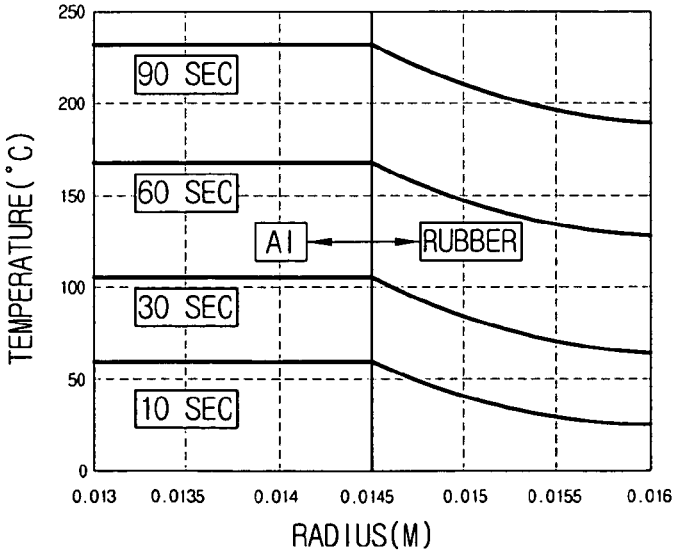
FIG. 5 (PRIOR ART)
FIG. 5 is a graph illustrating a temperature distribution per time of a general fusing roller having a rubber layer which is used in the fusing system shown in FIG. 1.

The description about the fusing roller 111, the fusing-backup roller 113 and the heater 112 will be omitted here, as it is identical to that of the conventional rollers that were described with reference to FIGS. 1, 2 and 3.

The fusing temperature control unit 102 is provided with a paper feeding part 130 having a pickup roller 133 for picking up the sheet of printing paper, and a feed roller 135 for feeding the sheet of printing paper picked up by the pickup roller 133 to the fusing roller 111 of the fusing unit 101; a sensor part 114 having a thermistor 115 and a thermostat 116 installed with respect to the fusing roller 111 respectively to detect a surface temperature of the fusing roller 111 and to block an electric power from being supplied to the heater 112 when the surface temperature of the fusing roller 111 exceeds a given threshold; and a controller 120 having a power switching part 119 such as a thyristor for switching an AC power supply 118 to the heater 112.

The pickup roller 133 and the feed roller 135 of the paper feeding part 130 are connected through a gear train and/or a power switching device (not shown) with one driving motor or separate driving motors 125 (one shown), which is driven by the controller 120.

The controller 120 determines whether it is a heater driving-start timing to drive the heater 112, on the basis of a first time t1 and a second time t2, when the sheet of printing paper is picked up by the pickup roller 133. The first time t1 is a time from a point of time when the sheet of printing paper is picked up by the pickup roller 133 to a point of time when the sheet of printing paper arrives at the fusing roller 111, and the second time t2 is a time required until a heat generated from the heater 112 reaches a surface of the fusing roller 111. When the controller 120 determines that the heater driving-start timing should begin, it calculates a heater driving time th according to a target surface temperature Tt for the fusing roller 111 previously determined as a temperature required in fusing, a surface temperature Temp of the fusing roller 111 detected by the thermistor 115 of the sensor part 114, and a changeable slope of the surface temperature Temp of the fusing roller 111, and then drives the heater 112 for the calculated heater driving time th.

At this point, the heater driving-start timing is determined by a time subtraction of the second time t2 from the first time t1 to assure that the heat of the preheated heater 112 reaches the surface of the fusing roller 111 when the sheet of printing paper arrives at the fusing roller 111.

Alternatively, to prevent a leading end of the sheet of printing paper fed to the fusing roller 111 from being heated above the target surface temperature Tt, the heater driving-start timing can be delayed for a predetermined time, for example, one second during which the surface temperature Temp of the fusing roller 111 falls as much as 2° C. as the sheet of printing paper passes through the fusing roller 111, from the subtraction of the second time t2 from the first time t1.

Also, it is preferable that the heater driving time th is calculated in the range of integer times as large as the period of paper supply, based on the following mathematical formula 1.

$$th=\alpha\times(Tt-\text{Temp})-\beta\times a+\gamma, \quad (1)$$

where α is a proportional constant, β is a differential coefficient, and γ is a constant.

Here, values of the proportional constant α, the differential coefficient β, and the constant γ, which vary according to a structure of the fusing unit 101 and type of paper, are obtained by experimentation.

As described above, in the fusing system 100 of the embodiment of the present invention, since the heater driving-start timing is determined by subtraction of the second time t2 from the first time t1 and the heater driving time th to drive the heater 112 is determined according to the target surface temperature Tt of the fusing roller 111, the surface temperature Temp of the fusing roller 111, and the changeable slope a of the surface temperature Temp of the fusing roller 111 when the heater driving-start timing begins, the heat of the preheated heater 112 can reach to the surface of the fusing roller 111 when the sheet of printing paper arrives at the fusing roller 111, thereby considerably reducing a fluctuation width in the surface temperature of the fusing roller 111 having the rubber layer 111*a*.

Figure 7:
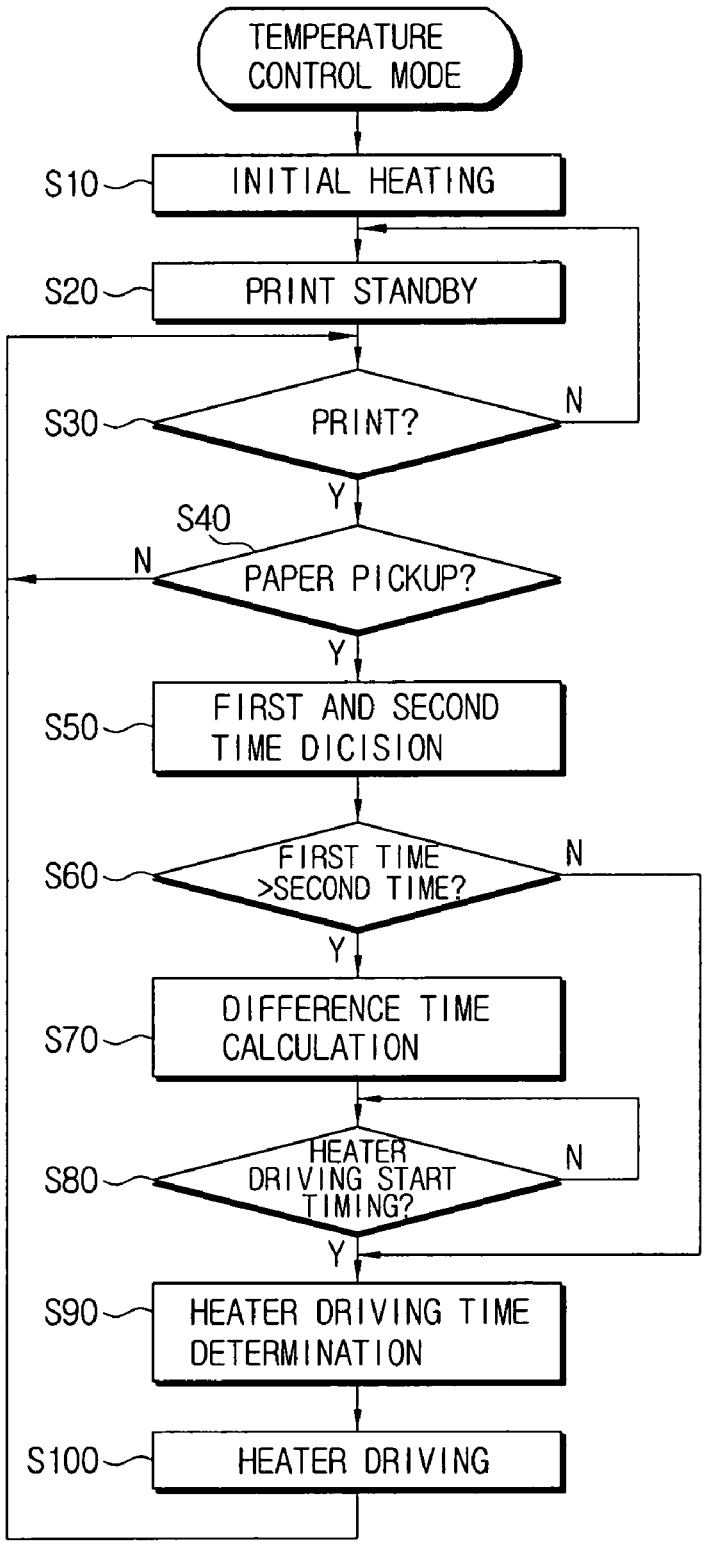
FIG. 7 is a flow chart illustrating a temperature control process of the fusing system shown in FIG. 6 according to a first embodiment of the present invention.

Hereinafter, descriptions will be made in detail concerning the temperature control method for use in the fusing system 100 of the image forming apparatus according to the first embodiment of the present invention with reference to FIG. 7.

Firstly, when an electric power is supplied to the fusing unit 100 after the image forming apparatus is turned on, the controller 120 drives the heater 112 to rise to a surface temperature Temp of the fusing roller 111, which is maintained at a room temperature, to a print standby temperature (for example 165° C.) close to a predetermined target surface temperature Tt, i.e., a fusing temperature (for example, 170–180° C.) required in fusing the toner image (S10), and then maintain the surface temperature Temp of the fusing roller 111 at the print standby temperature by turning on and off the heater 112 through the thermistor 115 or alternatively at intervals of predetermined time as in the conventional fusing system 10 (S20). As a result, the fusing roller 111 can proceed with a fusing operation at any moment.

Subsequently, when a print command is input from a PC and the like (S30), the controller 120 drives the pickup roller 133 of the paper feeding part 130 through the driving motor 125 to pick up a sheet of printing paper.

At this time, the controller 120 determines whether the sheet of printing paper is picked up on the basis of whether it transmits a driving signal to the driving motor 125 (S40).

After determining that the sheet of printing paper is picked up, the controller 120 reads a first time t1 and a second time t2 from a memory (not shown) thereof to determine whether it is a heater driving start time (S50). The first time t1 is a time until the sheet of printing paper arrives at the fusing roller 111 of the fusing roller 101 via an image forming unit (not shown) by the feed roller 135 of the paper feeding part 130 after being picked up by the pickup roller 133, and the second time t2 is a time until a heat radiated after the heater 112 is turned on reaches a surface of the fusing roller 111.

Here, the first time t1 or the second time t2 is explained as previously stored in the controller 120, but it can be directly measured during the operation of the image forming apparatus. For example, the first time t1 can be obtained by counting from when the controller 120 determines that the sheet of printing paper is picked up to when the sheet of printing paper arrives at the fusing roller 111 of the fusing unit 101. Also, the first time t1 or the second time t2 can be adjusted to a value adapted for use in the image forming apparatus by comparing the previously stored value with the counted time.

Subsequently, since if the second time t2 is larger than the first time t1, the heat radiated just after the heater 112 begins to be driven does not reach the surface of the fusing roller 111 when the sheet of printing paper arrives at the fusing roller 111 of the fusing unit 101 even though the heater 112 is driven for all of the first time t1, the controller 120 determines whether the second time t2 is larger than the first time t1, in order to determine whether to directly perform a step S90 of determining a heater driving time th of the heater 112 which will be described in detail later (S60).

As a result of the determination at step S60, if the second time t2 is larger than the first time t1, the controller 120 directly performs the step S90 of determining the heater driving time th of the heater 112, and if the second time t2 is smaller than the first time t1, the controller 120 calculates a difference in time t between the first time t1 and the second time t2 to determine a heater driving-start timing (S70).

Thereafter, the controller 120 determines whether it is heater driving-start timing on the basis of the difference time t between the first time t1 and the second time t2 (S80).

For example, if the first time t1 is four seconds and the second time t2 is three seconds, the controller 120 determines that it is heater driving-start timing after a difference time t therebetween, that is, one second.

However, when the heater 112 is driven from prior to the second time t2, i.e., three seconds, the heat reached to the surface of the fusing roller 111 after being radiated from the heater 112 three seconds ago transfers to the sheet of printing paper as soon as the sheet of printing paper arrives at the surface of the fusing roller 111 of the fusing unit 101, so that a temperature at a leading end of the sheet of printing paper may rise above the fusing temperature, i.e., the target surface temperature Tt. To prevent this, the heater driving timing can be delayed for a predetermined time, for example, one second during which the surface temperature Temp of the fusing roller 111 falls as much as 2° C. as the sheet of printing paper passes through the fusing roller 111, from the subtraction in time of the second time t2 from the first time t1. Accordingly, in this case, the heater driving timing is determined after two seconds from the point of time when the sheet of printing paper is picked up.

As described above, after determining that it is time to drive the heater, the controller 120 calculates a heater driving time th on the basis of the mathematical formula 1 as described above according to the target surface temperature Tt, i.e., the fusing temperature of the fusing roller 111, the surface temperature Temp of the fusing roller 111 detected by the thermistor 115 of the sensor part 114, and a changeable slope a of the surface temperature Temp of the fusing roller 111 (S90), and then drives the heater 112 for the calculated heater driving time th (S100).

For example, if the fusing temperature Tt is 170° C., the surface temperature Temp of the fusing roller 111 detected by the thermistor 115 is 168° C. and the surface temperature Temp of the fusing roller 111 is falling as much as 2° C. per ten seconds, the heater driving time th is calculated by the following formula.

$$th=\alpha\times(170^\circ\text{ C.}-168^\circ\text{ C.})-\beta\times(-0.2)+\gamma$$

If the heater driving time th is calculated over an interval of the period of paper pickup or supply, the controller 120 again updates the heater driving time th at a new step S90 in a fusing operation of the following period, and drives the heater 112 for the updated heater driving time th.

Also, At the step S90 of calculating the heater driving time th, since there is a decrease in the surface temperature of the fusing roller 111 when the printing speed exceeds a predetermined speed, in order to maintain the surface temperature Temp of the fusing roller 111 at the target surface temperature Tt, i.e., the fusing temperature, the heater driving time th can be set by the period of paper pickup thereby to continuously drive the heater 112 while the sheet of printing paper passes through the fusing roller 111.The printing speed is determined by information on the printing speed previously input in the controller 120, a driving period of the pickup roller 133 for picking up the sheet of printing paper, or a feeding speed of the sheet of printing paper conveyed by the feed roller 135, that is, a rotating speed of the feed roller 135.

For example, assuming that in an image forming apparatus having a printing speed of more than 20 page per minute in which the driving period of the pickup roller 133 is three seconds, the surface temperature Temp of the fusing roller 111 falls as much as 10° C. while the sheet of printing paper passes through the fusing roller 111, and goes up as much as 13° C. while the heater 112 is driven for three seconds, the surface temperature Temp of the fusing roller 111 can be maintained in the range of a fluctuation width of 1° C. to the fusing temperature Tt when the heater 112 is turned on for about nine seconds and turned off for about three seconds.

After the heater 112 is driven for the heater driving time th described above, the controller 120 controls again to perform the step S30 of deciding whether the print command is input and then to repeat the above described steps. At this point, at the step S30, if the print command is not input within a predetermined time, the controller 120 controls to finish the printing operation and to move to the step S20 of maintaining the surface temperature Temp of the fusing roller 111 at the print standby temperature.

Embodiment 2

Figure 8:
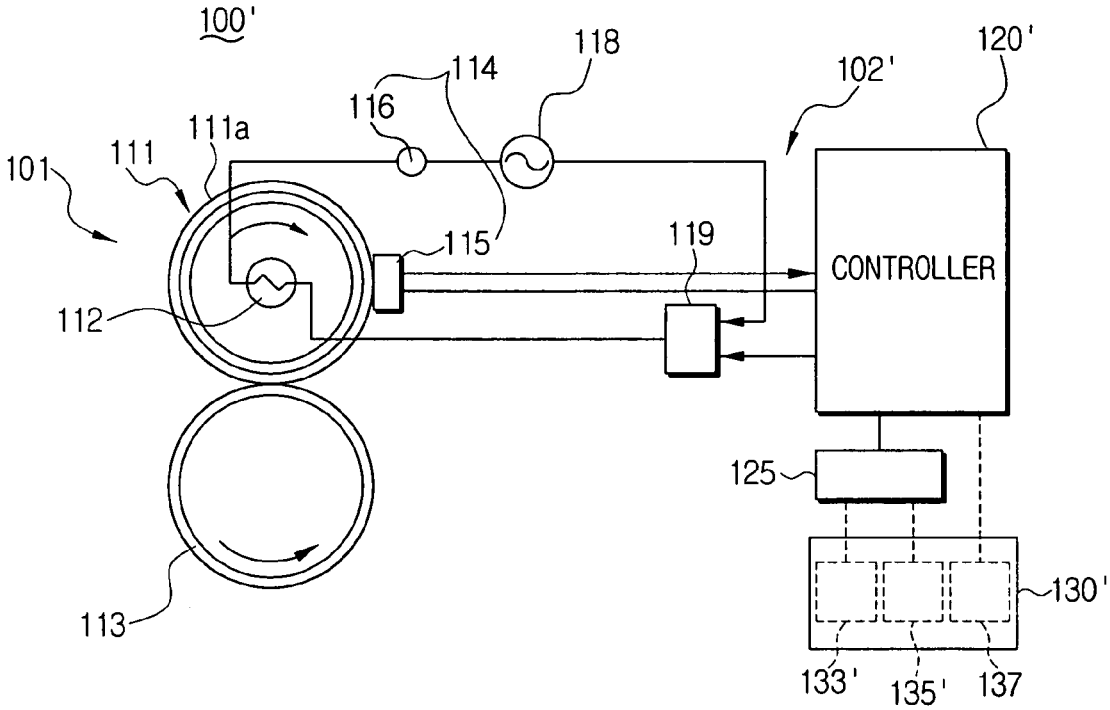
FIG. 8 is a schematic perspective view of a fusing system of an electrophotographic image forming apparatus according to a second embodiment of the present invention.

FIG. 8 is a block diagram illustrating a fusing system 100' according to a second embodiment of the present invention, which is applied to an electrophotographic image forming apparatus such as a laser printer, a copier, a FAX and the like.

The fusing system 100' includes a fusing unit 101 fusing toner image transferred on a sheet of printing paper (not shown) with a heat and a pressure to affix it thereon and having a fusing roller 111 with a heater 112, and a fusing temperature control unit 102' for determining a driving start timing and a driving time th of the heater 112 of the fusing unit 101 for a period of paper supply and controlling to drive the heater 112 for the determined driving time th.

The description about the fusing unit 101 will be omitted here, as it is identical to that of the conventional fusing unit described with reference to FIG. 6.

The fusing temperature control unit 102' is provided with a paper feeding part 130' having a pickup roller 133' for picking up the sheet of printing paper, a feed roller 135' for feeding the sheet of printing paper picked up by the pickup roller 133', and a paper jam sensor 137 for detecting whether the sheet of printing paper is normally fed and disposed at a lower part in the paper feed direction of the pickup roller 133', i.e., between the pickup roller 133' and the feed roller 135' or the fusing roller 111; a sensor part 114 having a thermistor 115 and a thermostat 116 installed with respect to the fusing roller 111 respectively to detect a surface temperature Temp of the fusing roller 111 and to block an electric power from being supplied to the heater 112 when the surface temperature of the fusing roller 111 exceeds a given threshold; and a controller 120' having a power switching part 119 such as a thyristor for switching an AC power supply 118 to the heater 112.

Similar to the pickup roller 133 and the feed roller 135 of the paper feeding part 130 explained with reference to FIG. 6, the pickup roller 133' and the feed roller 135' of the paper feeding part 130' are connected through a gear train and/or a power switching device (not shown) with one driving motor or separate driving motors 125 (one shown) which is driven by the controller 120'.

The controller 120' determines whether it is a heater driving-start timing to drive the heater 112, on the basis of a third time t3 and a second time t2, when the sheet of printing paper picked up by the pickup roller 133' operates the paper jam sensor 137. The third time t3 is a time from a point of time when the sheet of printing paper operates the paper jam sensor 137 to a point of time when the sheet of printing paper is arrives at the fusing roller 111, and the second time t2 is a time required until a heat radiated from the heater 112 reaches a surface of the fusing roller 111. When the controller 120 determines to begin the heater driving-start timing, it calculates a heater driving time th according to a target surface temperature Tt for the fusing roller 111 previously determined at a temperature required in fusing, a surface temperature Temp of the fusing roller 111 detected by the thermistor 115 of the sensor part 114, and a changeable slope a of the surface temperature Temp of the fusing roller 111, and then drives the heater 112 of the fusing unit 101 for the calculated heater driving time th.

At this point, the heater driving-start timing is determined by subtraction of the second time t2 from the third time t3. Alternatively, to prevent a leading end of the sheet of printing paper fed to the fusing roller 111 from being heated above the target surface temperature Tt, the heater driving-start timing can be delayed for a predetermined time based on subtraction of the second time t2 from the third time t3.

Also, the heater driving time th is determined in the range of integer times as large as a period of paper supply by the above described mathematical formula 1, as in the fusing temperature control unit 102 explained with reference to FIG. 6.

Figure 9:
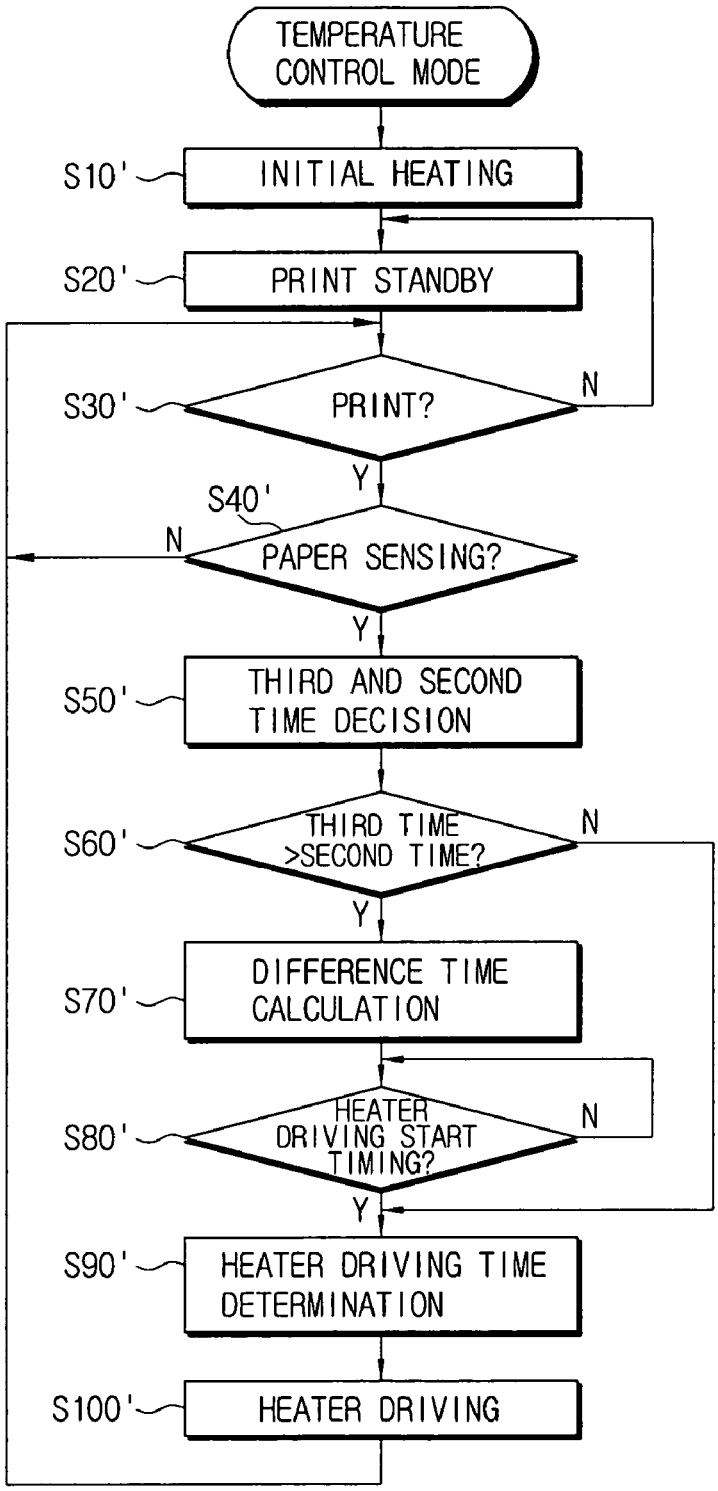
FIG. 9 is a flow chart illustrating a temperature control process of the fusing system shown in FIG. 8 according to a second embodiment of the present invention.

The description about the temperature control method of the fusing system 100' of the image forming apparatus according to the second embodiment of the present invention will be omitted here, at it is identical to that of the temperature control method of the fusing system 100 of the image forming apparatus described with reference to FIG. 7, except that since the sheet of printing paper may be jammed and not supplied to the fusing roller 111 when picked up by the pickup roller 133', the controller 120' determines whether the sheet of printing paper is picked up by receiving an 'on' signal from the paper jam sensor 137 after the sheet of printing paper picked up by the pickup roller 133' has operated the paper jam sensor 137, as shown in FIG. 9 (S40').

As apparent from the foregoing description, it will be appreciated that the fusing system and the temperature control method thereof for use in the image forming apparatus according to the embodiment of the present invention can obtain an effect that minimizes the fluctuation width in the surface temperature of the fusing roller thereby to stably maintain the surface temperature of the fusing roller and at the same time, to stably fix the toner image onto the sheet of printing paper, by determining the heater driving start timing and the heater driving time for the period of paper supply, with taking account of the time required until the sheet of printing paper arrives at the fusing roller and the time required until the heat radiated from the heater reaches to the surface of the fusing roller, and then driving the heater for the determined heater driving time.

Although the embodiments of the present invention have been described, it will be understood by those skilled in the art that the present invention should not be limited to the described embodiments, but various exchanges and modifications can be made within the spirit and the scope of the present invention. Accordingly, the scope of the present invention is not limited within the described range but the following claims.

What is claimed is:

1. A temperature control method of a fusing system for use in an image forming apparatus comprising the steps of:

determining whether it is a heater driving-start time to drive a heater for heating a fusing roller of a fusing unit, the heater driving-start time being based on at least a time when a sheet of printing paper is fed by a paper feeding part; and driving the heater when it is determined that it is the heater driving-start time.

2. The temperature control method of claim 1, wherein the step of determining whether it is the heater driving-start time comprises the steps of:

determining whether the sheet of printing paper is fed by the paper feeding part; and determining whether it is the heater driving-start time to drive the heater when it is determined that the sheet of printing paper is fed by the paper feeding part.

3. The temperature control method of claim 2, wherein the operation of determining whether the sheet of printing paper is fed by the paper feeding part comprises one of the steps of:

determining whether a pickup roller for picking up the sheet of printing paper of the paper feeding part is driven, and determining whether a paper jam sensor is operated, the paper jam sensor being disposed at a lower part in a paper feed direction of the pickup roller.

4. The temperature control method of claim 3, wherein the operation of determining whether to initiate the heater driving-start timing comprises the steps of:

determining one of a first time t1 and a third time t3, and a second time t2, the first time t1 being a time from when the sheet of printing paper is picked up by the pickup roller to when the sheet of printing paper arrives at the fusing roller, the second time t2 being a time required until a heat generated from the heater reaches a surface of the fusing roller, and the third time t3 being a time from when the sheet of printing paper operates the paper jam sensor to when the sheet of printing paper arrives at the fusing roller; and determining the heater driving-start time by determining whether a difference in time t between the one of the first time t1 and the third time t3 and the second time t2 elapses.

5. The temperature control method of claim 4, wherein the operation of determining the heater driving-start timing comprises the step of:

delaying for a predetermined time after the difference in time t between one of the first time t1 and the third time t3 and the second time t2 has elapsed.

6. The temperature control method of claim 4, further comprising the steps of: determining whether the second time t2 is larger than the one of the first time t1 and the third time t3 after the operation of determining one of the first time t1, the second time t2 and the third time t3; and directly moving to the step of driving the heater when it is determined that the second time t2 is larger than one of the first time t1 and the third time t3.

7. The temperature control method of claim 4, further comprising the steps of:

determining whether a surface temperature Temp of the fusing roller is above a target surface temperature Tt after the operation of determining the heater driving-start time by determining whether the difference time t elapses; and stopping the driving of the heater when it is determined that the surface temperature Temp of the fusing roller is above the target surface temperature Tt.

8. The temperature control method of claim 4, further comprising the step of:

controlling to alternately turn on and off the heater when a printing speed exceeds a predetermined speed after the operation of determining the heater driving-start time by determining whether the difference time t elapses.

9. The temperature control method of claim 8, wherein the printing speed is determined by one of:

information of printing speed previously input in the image forming apparatus, a driving period of the pickup roller of the paper feeding part, and a feeding speed of the sheet of printing paper conveyed by a feed roller of the paper feeding part.

10. The temperature control method of claim 1, wherein the step of driving the heater comprises:

calculating a heater driving time th according to at least one factor selected from a target surface temperature Tt for the fusing roller previously determined at a temperature required in fusing, a surface temperature Temp of the fusing roller detected by a sensor part, and a changeable slope a of the surface temperature Temp of the fusing roller, when it is determined that it is the heater driving-start time; and driving the heater for the calculated heater driving time th.

11. The temperature control method of claim 10, wherein the heater driving-start time th is calculated by the following mathematical formula:

$$th=\alpha\times(Tt-\text{Temp})-\beta\times a+\gamma,$$

where $\alpha$ is a proportional constant, $\beta$ is a differential coefficient, and $\gamma$ is a constant.

12. A fusing system of an image forming apparatus comprising:

a fusing unit having a fusing roller and a heater for heating the fusing roller;

a fusing temperature control unit having a paper feeding part having at least one of a pickup roller for picking up a sheet of printing paper and a paper jam sensor;

a sensor part for sensing a surface temperature Temp of the fusing roller; and a controller for determining whether it is time to drive the heater for heating the fusing roller of the fusing unit, wherein the time to drive the heater is based on at least a time when a sheet of printing paper is fed by the paper feeding part, and driving the heater when it is time to drive the heater.

13. The fusing system of claim 12, wherein a sheet of printing paper is fed by the paper feeding part when a sheet of printing paper is picked up by the pickup roller and/or when a leading end of the sheet of printing paper picked up by the pickbp roller operates the paper jam sensor;

wherein the controller determines whether it is time to drive the heater by determining a heater driving-start time, the heater driving-start time being determined on the basis of one or more of a first time t1, second time t2 and a third time t3, the first time t1 being a time from when the sheet of printing paper is picked up to when the sheet of printing paper arrives at the fusing roller, the second time t2 being a time required until a heat generated from the heater reaches a surface of the fusing roller, and the third time t3 being a time from when the sheet of printing paper operates the paper jam sensor to when the sheet of printing paper arrives at the fusing roller: and when determined that it is the heater driving-start time, calculating a heater driving time th according to at least one factor selected from a target surface temperature Tt for the fusing roller that is a previously determined temperature required for fusing, a surface temperature Temp of the fusing roller detected by the sensor part, and a changeable slope a of the surface temperature Temp of the fusing roller, and then driving the heater for the calculated heater driving time th.

14. The fusing system of claim 13, wherein the heater driving-start time is determined by subtraction of the second time t2 from the one of the first time t1 and the third time t3.

15. The fusing system of claim 13, wherein the heater driving time th is calculated using the following mathematical formula:

$$th=\alpha\times(Tt-\text{Temp})-\beta\times a+\gamma,$$

where $\alpha$ is a proportional constant, $\beta$ is a differential coefficient, and $\gamma$ is a constant.

16. The fusing system of claim 13, wherein the determined heater driving-start time is delayed for a predetermined time based on a subtraction of the second time t2 from at least one of the first time t1 and the third time t3.

17. A temperature control method of a fusing system for use in an image forming apparatus comprising the steps of:

detemrining whether it is a heater driving-start time to drive a heater for heating a fusing roller of a fusing unit when a sheet of printing paper is fed by a paper feeding part;

calculating a heater driving time th according to at least one factor selected from a target surface temperature Tt for the fusing rollerpreviously determined at a temperature required in fusing, a surface temperature Temp of the fusing roller detected by a sensor part, and a changeable slope a of the surface temperature Temp of the fusing roller, when it is determined that it is the heater driving-start time; and driving the heater when it is determined that it is the heater driving-start time and driving the heater for the calculated heater driving time th.

18. The temperature control method of claim 17, wherein the heater driving-start time th is calculated by the following mathematical formula:

$$th=\alpha\times(Tt-\text{Temp})-\beta\times a+\gamma,$$

where $\alpha$ is a proportional constant, $\beta$ is a differential coefficient, and $\gamma$ is a constant.

* * * * *